United States Patent [19]

Durazzani

[11] Patent Number: 4,538,433

[45] Date of Patent: Sep. 3, 1985

[54] WASHING MACHINE TUB HAVING INTEGRAL SHEET METAL BAND

[75] Inventor: Piero Durazzani, Pordenone, Italy

[73] Assignee: Industrie Zanussi S.p.A., Pordenone, Italy

[21] Appl. No.: 611,163

[22] Filed: May 17, 1984

[30] Foreign Application Priority Data

Jun. 22, 1983 [IT] Italy ..... 34032/83[U]

[51] Int. Cl.[3] ..... D06F 37/22

[52] U.S. Cl. ..... 68/140; 68/23.2; 220/71; 312/253

[58] Field of Search ..... 68/24, 139, 140, 144, 68/142, 23.2; 248/674; 312/253, 254; 220/71

[56] References Cited

U.S. PATENT DOCUMENTS 4,411,143 10/1983 Scholl et al. ..... 68/140 X
4,423,607 1/1984 Munini ..... 68/140

FOREIGN PATENT DOCUMENTS 1168137 12/1958 France ..... 68/140
106877 3/1943 Sweden ..... 68/140
2010926 7/1979 United Kingdom .

*Primary Examiner*—Philip R. Coe
*Assistant Examiner*—Frankie L. Stinson
*Attorney, Agent, or Firm*—Wenderoth, Lind & Ponack

[57] ABSTRACT

A washing machine tub includes a cylindrical shell of stainless steel and having an open front end and an opposite end closed by a rear wall. A cross member is fixed to the rear wall to support a shaft of a basket to revolve within the shell. A sheet metal cylindrical band covers the outer surface of the shell over a portion of the axial length thereof. The band is integrally connected to the outer surface of the shell by a metal working operation and is releasably connected to the cross member by means of attachment members.

8 Claims, 4 Drawing Figures

WASHING MACHINE TUB HAVING INTEGRAL SHEET METAL BAND

BACKGROUND OF THE INVENTION

The present invention relates to a washing machine tub for use in a front loading washing machine, particularly a household washing machine. More specifically, the present invention relates to such a washing machine tub which may be formed of a relatively thin material such as stainless steel.

In recent years there has been a growing tendency to switch from enameled tubs to stainless steel tubs. This development has many technical advantages as will be apparent to those skilled in the art. However, in order to make this development cost competitive, it must be possible to use some existing assembly parts previously employed for enameled tubs, as well as to modify the tub structure so that it no longer acts as a support for the many various functional elements of the washing machine. Therefore, many solutions have been proposed to achieve this development.

The first such solution provided for a reduction of the thickness of the tub and for applying to the outer surface thereof a drawn metal shell to which the other functional elements of the washing machine are secured, as disclosed in British Pat. No. 2010926 B. This solution, even though it achieves the desired objective, has been found difficult to carryout, since such solution requires special machinery capable of manufacturing shells by a deep-drawing operation.

A subsequent solution provided for a modification of the support of the tub by extending the hub with offset arms running parallel to the axis of the hub and securing thereto the functional elements of the washing machine. However, even this solution has not been put into practical application, since substantial changes would have to be made in the entire structure of the tub, thereby making its manufacture less reliable.

SUMMARY OF THE INVENTION

With the above discussion in mind, it is the primary object of the present invention to provide a washing machine tub formed of a material such as stainless steel for washing machines of the type described above, and which can be produced effectively without having to resort to special production equipment and without requiring changes in the other structural features of the washing machine, while at the same time realizing considerable savings in material and ensuring a reliable operation.

This and other objects are achieved in accordance with the present invention by the provision of a washing machine tub in the shape of a conventional shell having a generally cylindrical shape, an open front end and an opposite end closed by a rear wall. To the outer surface of the rear wall is attached a crosspiece or cross member for supporting, in a generally known manner, the shaft of a revolving basket to be positioned within the shell. A cylindrical band formed of sheet metal, for example galvanized or zinc sheet metal, covers the outer surface of the shell over an axial length thereof less than the total axial length. Preferably, the band extends over approximately half of the total length of the shell, and most preferably, over somewhat less than the total length of the shell. The band is integrally connected with the outer surface of the shell by a metal working operation, for example by a rolling or chiselling operation. Furthermore, the band is releasably connected to the cross member by attachment members.

The functional parts or elements of the washing machine, such as springs and dampers, motors and pumps, are fastened to the sheet metal band which is shaped to include integral brackets and flanges necessary for such connection. This provision lightens the weight of the tub shell which can be made of stainless steel with reduced thickness and also eliminate numerous welded joints that constitute critical stress and rust producing areas.

BRIEF DESCRIPTION OF THE DRAWINGS

The above and other objects, features and advantages of the present invention will be apparent from the following detailed description of preferred embodiments thereof, with reference to the accompanying drawings, wherein.

DETAILED DESCRIPTION OF THE INVENTION

Figure 1:
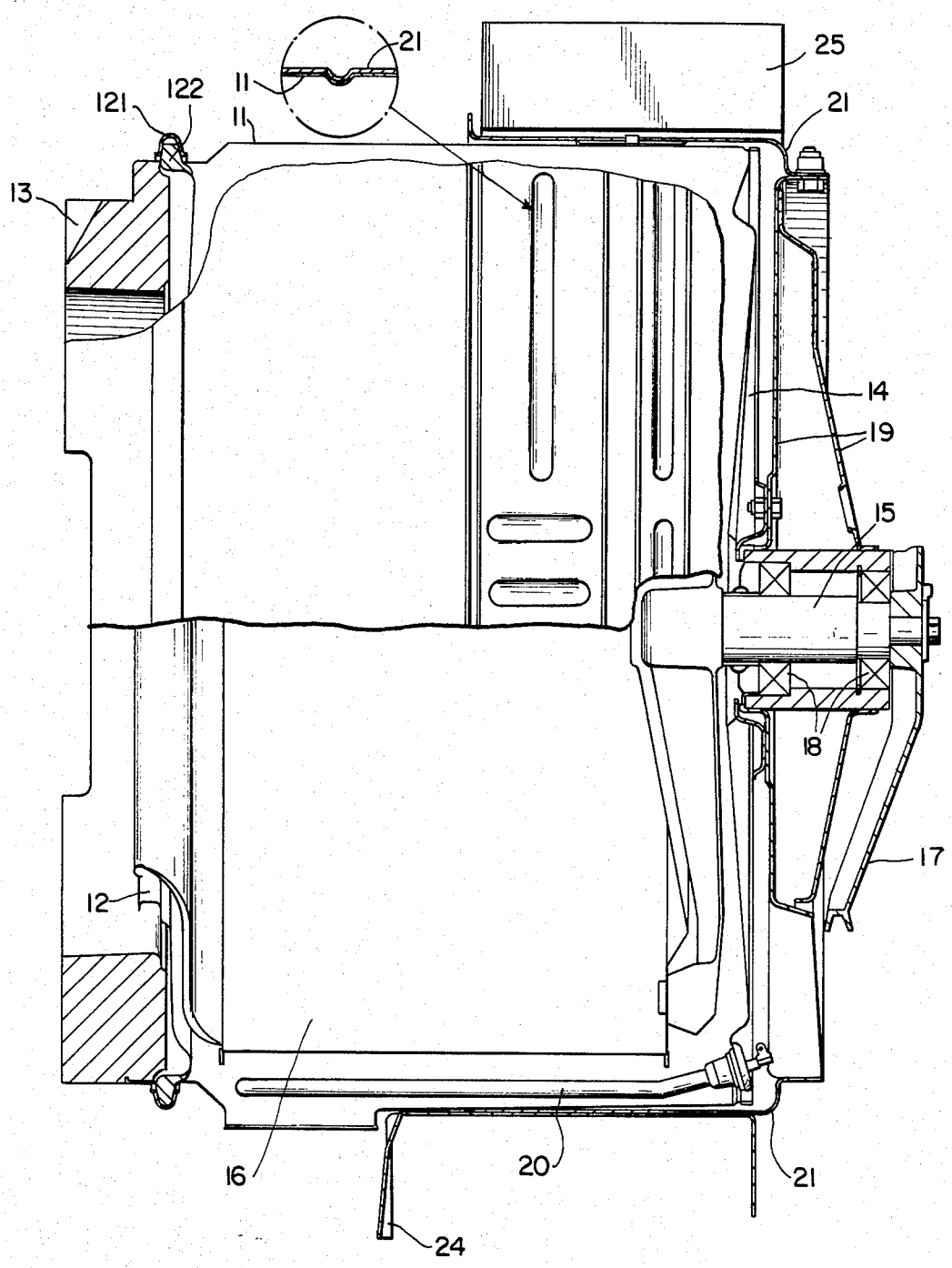
FIG. 1 is a somewhat schematic elevational view, partially in section, of one embodiment of a washing machine tub in accordance with the present invention.
Figure 2:
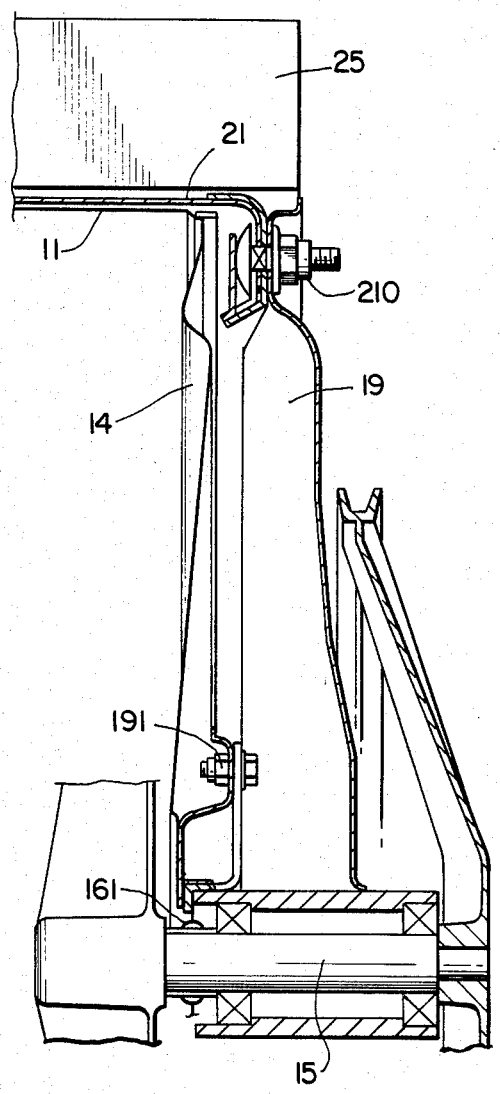
FIG. 2 is an enlarged detail, partially in section, of a modification of the arrangement of FIG. 1.

As shown in FIG. 1, the washing machine tub of the present invention includes a substantially cylindrical shell 11 formed of a material such as stainless steel and having a horizontal axis. The shell 11 has a front opening 12 to the rim of which is fastened in a known manner, for example by use of a rider ring 121, a gasket 122, and a counterweight 13. The opposite end of shell 11 is closed by an integral rear wall 14 having an axial opening through which passes a shaft 15 which achieves rotation of a basket 16 positioned within the shell. Shaft 15 extends through a suitable seal 161, as shown in FIG. 2. Shaft 15 is integral with a pully 17 which is caused to rotate by the belt of an electric motor (not shown) in a conventional manner. Shaft 15 is supported through bearings 18 by a crosspiece or cross member 19 fastened to rear wall 14 of shell 11, for example by means of nuts and bolts 191 (FIG. 2) in a known manner. In the lower region of the tub there is provided a heater, for example resistor heater 20, for heating of the washing water.

The main feature of the present invention is the provision of a cylindrical band 21, formed of a sheet metal material, such as a galvanized sheet metal, covering the outer surface of shell 11 over an axial length less than the total axial length of shell 11. In FIG. 1, the axial length of band 21 is shown as being approximately half the axial length of shell 11, but such axial length may be even less. Band 21 is integrally fixed or connected to the outer surface of shell 11 by a metal working operation, such as a rolling or chiselling operation. The detail in FIG. 1 shows that such metal working operation is achieved by a rolling deformation of the band 21 into shell 11, and the deformations may be achieved both cylindrically and axially as shown in FIG. 1. Such is intended to be exemplary only however, and those skilled in the art readily will understand other ways of achieving such integral connection. Additionally, band 21 is releasably connected to cross member 19 by means such as releasable attachment members such as nuts and bolts 210. The manner of fastening may be such that the bolts 210 extend radially as shown in FIGS. 1 and 4 or axially as shown in FIGS. 2 and 3.

Band 21 is shaped in such a way that it can have connected thereto and can support the various functional elements of the washing machine which previously were supported by the shell itself. Thus, the band 21 illustrated in the drawings has formed integrally therewith upper brackets 22 with coupling holes for the springs for suspending the tub and lower brackets 23 to be fastened to dampers or shock absorbers. Additionally, the band 21 has extending therefrom integral flanges 24 for a connection to the motor of the washing machine. Even further, at the upper part of the tub, the band 21 has connected thereto in a known manner another counterweight 25.

Figures 3, 4:
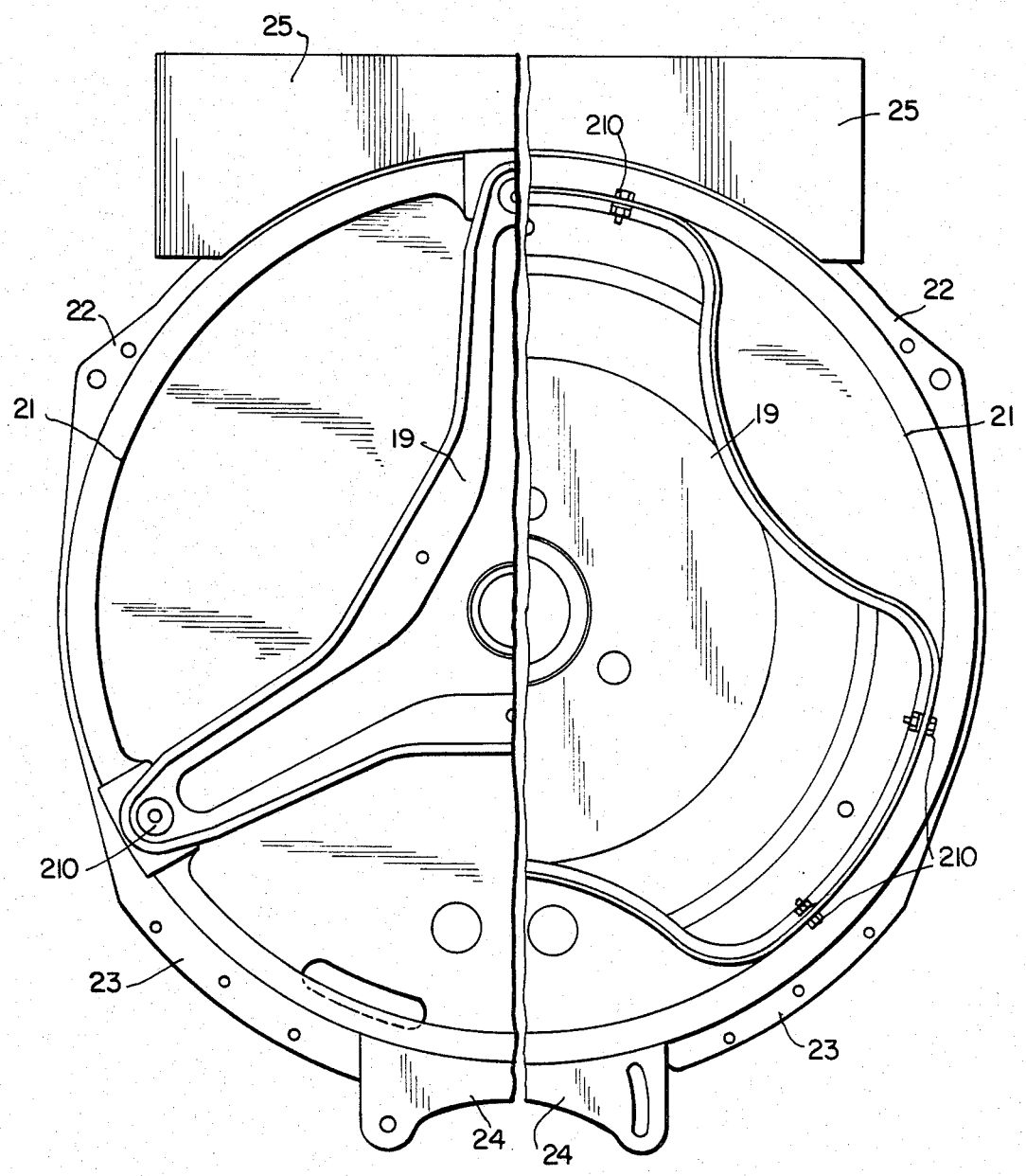
FIGS. 3 and 4 are partial views from the rear of two variations of features of the tub of the present invention.

FIGS. 3 and 4 illustrate two different constructions of cross member 19 and of the manner of connection therewith a band 21 by means of attachments 210. The crosspiece configuration and attachment arrangement shown in FIG. 3 is preferred for washing machines with a low centrifugal speed, for example up to approximately 500 rpm, and those of the arrangement of FIG. 4 are preferable for washing machines with a high centrifugal speed, for example at least 800 rpm. The tub of the present invention provides an efficient and economic solution to the problem of reducing the dynamic stresses on the tub by modifying its structure in a very simple way without having to resort to special production equipment and to manufacturing processes that are substantially different from conventional processes. Although the present invention has been described and illustrated with respect to preferred features and arrangements thereof, it will be apparent to those skilled in the art that various modifications and changes may be made to the specifically described and illustrated features without departing from the scope of the present invention.

What is claimed is:

1. A substantially horizontally disposed washing machine tub, particularly for a household washing machine, said tub comprising:

a cylindrical shell having an open front end and an opposite end closed by a rear wall;

a cross member fixed to said rear wall and adapted to support a shaft of a basket to be revolvably positioned within said shell;

a sheet metal cylindrical band covering the outer surface of said shell over an axial length thereof less than the total axial length thereof, said band being in direct contiguous contact with said shell over said axial length of said band;

said band being integrally connected to the outer surface of said shell over said axial length of said band by a metal working operation; and releasable attachment means for connecting said band to said cross member.

2. A tub as claimed in claim 1, wherein said attachment means extend generally radially of said shell and of said band.

3. A tub as claimed in claim 1, wherein said attachment means extend generally axially of said shell and of said band.

4. A tub as claimed in claim 1, wherein said band is shaped to include integral brackets and flanges for attachment to and support of other functional elements of the washing machine.

5. A tub as claimed in claim 1, wherein said band is integrally connected to the outer surface of said shell by a rolling operation.

6. A tub as claimed in claim 1, wherein said shell is formed of stainless steel.

7. A tub as claimed in claim 1, wherein said band is formed of galvanized sheet metal.

8. A tub as claimed in claim 1, wherein said band and said shell are integrally connected by circumferential and axial deformations of said band into said shell.

* * * * *